United States Patent [19]

Wager

[11] 4,057,500

[45] Nov. 8, 1977

[54] EARTH DRAIN

[75] Inventor: Oleg Wager, Bromma, Sweden

[73] Assignee: Burcan International Limited, Dublin, Ireland

[21] Appl. No.: 702,040

[22] Filed: July 2, 1976

[30] Foreign Application Priority Data

July 25, 1975 Canada ..... 232232

[51] Int. Cl.[2] ..... B01D 29/04; E02B 11/00

[52] U.S. Cl. ..... 210/170; 61/11; 210/486; 210/498

[58] Field of Search ..... 61/10, 11, 13; 210/170, 210/346, 347, 486, 487, 498, 461

[56] References Cited

U.S. PATENT DOCUMENTS

| | | | |
|---|---|---|---|
| 925,554 | 6/1909 | Blaisdell et al. | 210/487 |
| 1,377,022 | 5/1921 | Naugle | 210/346 |
| 1,721,250 | 7/1929 | Greenhalgh | 210/346 X |
| 2,964,194 | 12/1960 | Oliver, Jr. et al. | 210/486 |
| 3,563,038 | 2/1971 | Healy et al. | 210/486 X |
| 3,648,844 | 3/1972 | Krynski et al. | 210/347 X |
| 3,855,799 | 12/1974 | Martin et al. | 61/11 |
| 3,888,087 | 6/1975 | Bergslaud | 61/11 |

FOREIGN PATENT DOCUMENTS

| | | | |
|---|---|---|---|
| 930,999 | 7/1973 | Canada | 210/170 |

*Primary Examiner*—Wilbur L. Bascomb, Jr.
*Assistant Examiner*—Robert H. Spitzer
*Attorney, Agent, or Firm*—Wenderoth, Lind & Ponack

[57] ABSTRACT

An earth drain which comprises a filter encased core having, on at least one base or web surface, a first array of discrete projections or studs of uniform height and a second array of discrete projections or studs of lesser height than the projections or studs of the first array. The projections or studs of the second array are so disposed between the projections or studs of the first array that, under relatively low pressures, the filter encasing the core is maintained in spaced relationship with the base or web of the core by the free ends of the first array of projections or studs and, at relatively high soil pressures, the filter material forced inwardly toward the base of the core is supported by the free ends of the studs of the second array and is thus maintained in spaced relationship with the base of the core, the spacing corresponding to the height of the second array of projections or studs.

8 Claims, 6 Drawing Figures

EARTH DRAIN

BACKGROUND OF THE INVENTION

The present invention relates to earth drains adapted to the drainage of soil having low water permeability such, for example, as clay.

Certain soils such as clay have low water permeability and do not drain well with the result that such soils are often inappropriate for the purpose for which the land is intended, be it the construction of residential or commercial buildings, the construction of road beds or highways, or for agricultural or similar purposes. Such soils can be rendered more suitable for the purpose for which they are intended by the provision of drains which permit the pore water to be drained away before any intended construction is carried out. A basic drain used for this purpose is a conventional sand drain which is formed by inserting pipes into the ground through the layer of soil having low water permeability and into a layer of soil having relatively high water permeability such as sand or silt which drains water more readily. The pipe is filled with sand and then withdrawn leaving a column of sand extending through the soil layer having low permeability into the soil layer having relatively high permeability. The resulting sand column permits ground water to pass readily through the clay layer into the layer of relatively high permeability where it may be dispersed by normal drainage; alternately, the sand column may permit the ground water to escape upward to the ground surface. Such sand drain also permits drainage of pore water in the soil having low permeability, which pore water is squeezed out of the ground by a load, for example, a fill surcharge on the ground surface. The pore water is squeezed into the same column, which offers less resistance to the flow of water than the soil of low permeability, and which then permits the pore water to drain into the soil exhibiting relatively high water permeability, or to escape to the ground surface.

A drain which forms a substitute for the aforementioned sand column, and which may also be suitable for irrigation or similar purposes, is illustrated in Wager Canadian Pat. No. 930,999, dated July 31st, 1973. This drain is the type of drain to which this invention relates and consists of a relatively flat core consisting of a wave-shaped strip of plastic which is encased in a filter of water permeable sheet-like material. The troughs in the wave-shaped strip form channels for the dispersion of water and the filter material permits the passage of water therethrough into the troughs but prevents the ingress of soil or other particulate matter which would tend to block the channels formed by the troughs and thus deleteriously affect the performance of the drain. While this type of drain has many advantages over the basic sand drain, it also has certain disadvantages arising in part from the fact that there is no communication between the water carrying channels formed by the troughs in the wave-shaped strip of the core. Thus if one of the channels becomes blocked at any point throughout its length, such as by tearing or breakage of the filter material to permit the ingress of sand or particulate material, or by the soil pressure forcing the filter material into the troughs of the wave-shaped strip, the particular channel or channels so blocked become useless insofar as the drainage of water through the point of blockage is concerned. If many or all channels become blocked, the drain becomes ineffective. Further, even if none of the water carrying channels are blocked or their flow areas reduced by the earth pressure forcing the filter material into the channel, the effective flow area of such drains is relatively small owing to the relatively low ratio of open area to solid area.

SUMMARY OF THE INVENTION

The disadvantages of earth drains in accordance with the aforementioned Canadian Pat. No. 930,999 can be substantially reduced if not eliminated by the use of drains in accordance with the present invention. Such drains utilize a core having, on at least one base or web surface, a first array of discrete projections or studs of uniform height and a second array of discrete projections or studs of lesser height than the projections or studs of the first array. The projections or studs of the second array are so disposed between the projections or studs of the first array that, under relatively low pressures, the filter encasing the core is maintained in spaced relationship with the base or web of the core by the free ends of the first array of projections or studs and, at relatively high soil pressures, the filter material forced inwardly toward the base of the core is supported by the free ends of the studs of the second array and is thus maintained in spaced relationship with the base of the core, the spacing corresponding to the height of the second array of projections or studs. Preferably, the core of the drain will have corresponding arrays of projections or studs on both surfaces and apertures will be provided in the core to permit water to pass freely from one side of the core to the other.

The drain of the present invention, owing to the use of discrete studs as opposed to elongated corrugations, permits both lateral and vertical flow of water through the drain in a random manner and the apertures through the core permit water to pass freely from one side of the core to the other if for any reason the flow area along one side of the core should be blocked or reduced. Further, the ratio of free area to solid area is high when contrasted with the known corrugated construction and a correspondingly higher flow of water is permitted through the drain. A further advantage is that the use of two arrays of projections or studs prevents the soil pressure from forcing the filter material against the base or web of the core to completely block any flow channel and, if, in the unlikely event this should happen, the provision for the lateral flow of water over the core permits water to bypass any such obstruction. A further advantage of the drain of the present invention is that the open flow area through the filter is increased several times in comparison with the drain of Canadian patent 930,999 which proportionately increases the efficiency of the drain of the present invention over that of the known drain.

BRIEF DESCRIPTION OF THE DRAWINGS

In drawings which illustrate an embodiment of the invention.

DESCRIPTION OF THE PREFERRED EMBODIMENTS

Figure 1:
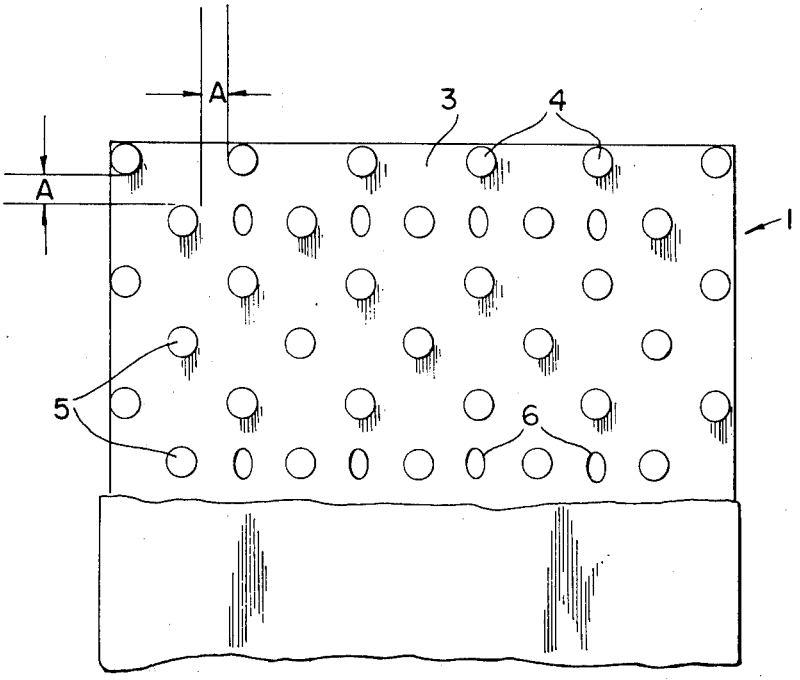
FIG. 1 is a plan view of a drain segment with the filter partly broken away to show the arrangement of studs or projections.

The drain illustrated in the drawings comprises a core generally designated 1 encased in a sheath of filter material 2 which completely surrounds the core and permits the passage of water therethrough while preventing the ingress of particulate matter such as sand grains, silt or clay particles or the like. The core has a relatively thin base or web 3 from both sides of which project a first array of projections or studs 4 of uniform height, and a second array of projections or studs 5 of uniform height, but of less height than the studs 4. In the embodiment illustrated, the studs 4 and 5 are arranged in regularly spaced rows longitudinally and transversely relative to the web, and the longitudinal rows of studs 5 are staggered relative to the longitudinal rows of studs 4 so that each stud 5 is centrally disposed with respect to four adjacent studs 4. This particular regular arrangement is not essential, although it is preferable as to appearance, ease of manufacture and operability. Further, it is not essential that there be studs arranged on both surfaces of the web 3, although, again, the provision of studs on both surfaces is preferable in most cases in that it doubles the flow area available for drainage water when contrasted with an embodiment having studs on only one surface of the web 3.

Both the core 1 and the filter 2 may be formed of any of a variety of materials suitable for the purpose. Suitably the core may be formed of polyethylene, although other suitable plastics materials or even metals such as steel or aluminum could be used, and the filter may be formed of a suitable heavy duty filter paper such as is used commercially with earth drains such as those disclosed in the aforementioned Canadian Pat. No. 930,999. The dimensions of the drain are not critical, although a typical drain may have a web thickness of about 1 millimeter, a width of about 100 millimeters, studs 4 and 5 of about 2 millimeters in diameter with studs 4 being about 2.5 millimeters in height and studs 5 being about 1.25 millimeters in height. Preferably, the distances A between the outer extremities of rows of studs 4 and 5 will be in the order of about twice the thickness of the filter material, for example between 0.5 and 2 millimeters to minimize the likelihood of the filter material being pressed into contact with the web under high soil pressures. The drain may be made of any convenient length, for example, 500 feet or more. If such lengths of drain are produced it is convenient that the material of which the drain is composed be relatively flexible so that it can be stored in coils or rolls. It will be appreciated that, in the drawings, distances and sizes have been exaggerated for the purposes of illustration and are not intended to be scale.

Figure 2:
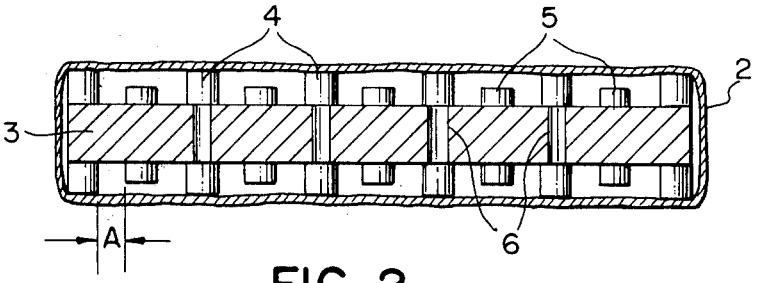
FIG. 2 is a cross section of the drain of FIG. 1 showing the relationship between the core and the filter material under relatively low soil pressures.

FIG. 2 of the drawings illustrates, in cross section, the relationship between the filter 2 and the core before the drain is installed or where the installed drain is subjected to relatively low soil pressures. In such cases the filter will be supported by the free ends of the studs 4 so that the free spaces between the studs (as best seen in FIG. 1) and the web and the filter will form a flow passage for drainage water.

Figure 3:
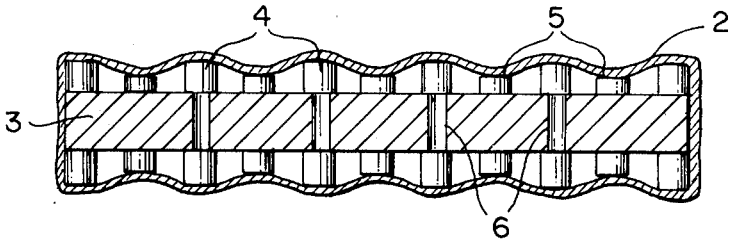
FIG. 3 is a cross section of the drain of FIG. 1 showing the relationship between the filter material and the core under relatively high soil pressures.

FIG. 3 illustrates, in cross section, an installed drain which is subjected to relatively high soil pressures. In this case, the flow passage for drainage water is constricted somewhat when contrasted with FIG. 2 in that the soil pressure forces the filter material inwardly toward the core web. However, when this occurs, the auxiliary or lower studs 5 will provide additional support for those portions of the filter which are forced inwardly and, provided the distance "A" is not greater than twice the thickness of the filter material, it will be practically impossible for the filter material to be forced into contact with the web to completely constrict the drainage water flow passage. Indeed, even where distance "A" is greater than twice the thickness of the filter material, the arrangement of studs is such that without rupture of the filter, it would be practically impossible to completely block the flow passage for drainage water. However, in the unlikely event that this should occur, apertures 6 may be provided through the web to bring the flow passages on each side of the web into fluid communication. Thus, if for any reason the flow passage on one side should become blocked or unduly restricted, drainage water passing down the blocked or constricted side may pass freely to the other side and thus bypass the restriction.

The embodiment illustrated in FIGS. 1, 2 and 3 is a preferred embodiment shown for purposes of illustration only. It will be appreciated that various modifications will be possible, for example, in both the form and arrangement of studs. The studs illustrated in the embodiment of FIGS. 1, 2 and 3 are of circular cross-section although other cross-section such as square, rectangular, cruciform, etc. would also be available for use and, in certain circumstances, may be considered preferable.

Figure 6:
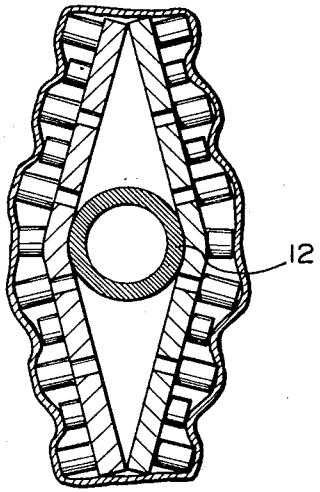
FIG. 6 is a cross section of the drain of FIG. 5, separated to receive a tube.
Figure 4:
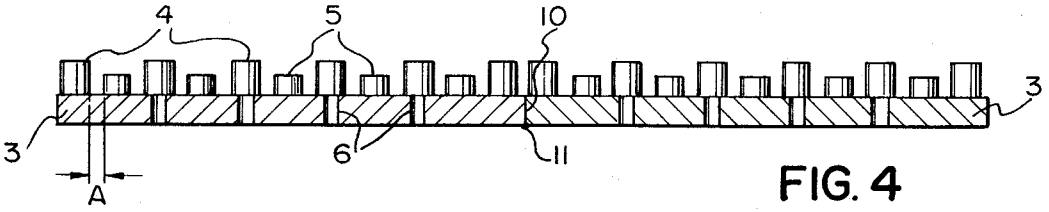
FIG. 4 is a cross section of a modified core construction.
Figure 5:
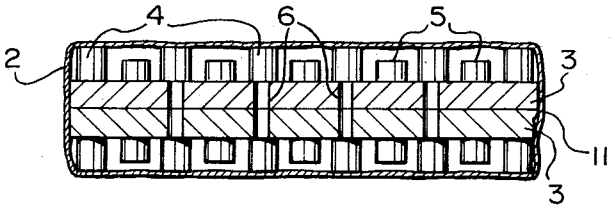
FIG. 5 is a cross section of a drain embodiment incorporating the modified core construction of FIG. 4.

A modified embodiment of the drain of FIGS. 1, 2 and 3 is shown in FIGS. 4, 5 and 6 in which like components are identified by the same reference numerals as used in the previous figures. The difference between this modified embodiment and that of FIGS. 1, 2 and 3 lies principally in the construction of the core. According to this embodiment, the core is comprised of a single web which has studs 4 and 5 formed on only one surface thereof and which cut partially through at 10, along its longitudinal centerline to leave a connected hinge portion 11. The web portions on each side of the centerline are identical so that the web may be folded about the hinge 11 to form a core which corresponds to that of FIGS. 1, 2 and 3 as illustrated in FIG. 5.

The advantage of this modified embodiment, apart from ease of manufacture of the core, is that the two halves of the core may be spread apart slightly as shown in FIG. 6 for insertion of a pipe, tube or the like 12 therebetween. Such tube may be used for injection of chemicals, such as lime into the soil, through the drain, for the purpose of improving the properties of the soil adjacent to the drain.

What I claim as my invention is:

1. An earth drain comprising a core consisting of an elongated web having on at least one surface thereof a first array of discrete, longitudinally and transversely spaced projections of uniform height, and a second array of discrete, longitudinally and transversely spaced projections of a height less than the projections of said first array, the projections of said second array being interspersed amongst projections of said first array, and a filter of sheet-like water permeable material encasing said at least one surface, said projections in said second array being spaced from the adjacent projections in said first array for blocking the approach of the central area of said filter among a group of projections in said first array which surround said central area toward said core under high soil pressure conditions and keeping the spaces between adjacent projections of said first and second arrays free for liquid pressure communication therethrough.

2. An earth drain as claimed in claim 1, wherein said web is of uniform width and said first and second arrays of projections are disposed on both surfaces thereof.

3. An earth drain as claimed in claim 2, wherein said first array comprises longitudinally disposed rows of regularly spaced projections with adjacent rows being separated by longitudinally disposed rows of regularly spaced projections of uniform height comprising said second array, the rows of projections in said second array being staggered with respect to the rows of projections of said first array.

4. An earth drain as claimed in claim 2, wherein said web has a plurality of apertures therethrough web.

5. An earth drain comprising an elongated water impermeable flexible web of uniform width and having, on each surface thereof, a first array of longitudinally disposed, transversely spaced rows of discrete, regularly spaced projections of uniform height, and a second array of longitudinally disposed, transversely spaced rows of discrete, regularly spaced projections of uniform but of lesser height than the projections of said first array, each longitudinal row of said first array being separated from an adjacent row of said first array by a longitudinally disposed row of said second array, and a filter of sheet-like water permeable material encasing said web, said projections in said second array being spaced from the adjacent projections in said first array for blocking the approach of the central area of said filter among a group of projections in said first array which surround said central area toward said core under high soil pressure conditions and keeping the spaces between adjacent projections of said first and second arrays free for liquid pressure communication therethrough.

6. An earth drain as claimed in claim 5, wherein the rows of said second array are staggered with respect to the rows of said first array in the longitudinal direction of the web, so that each projection in said second array is centrally disposed with respect to four adjacent projections in said first array.

7. An earth drain as claimed in claim 6, wherein said web is provided with a plurality of apertures therethrough.

8. An earth drain as claimed in claim 5, wherein said projections are of circular cross-section.

* * * * *